United States Patent [19]

Ohe et al.

[11] Patent Number: 4,804,968

[45] Date of Patent: Feb. 14, 1989

[54] VEHICLE ANTENNA SYSTEM

[75] Inventors: Junzo Ohe, Toyota; Hiroshi Konda, Okazaki, both of Japan

[73] Assignee: Toyota Jidosha Kabushiki Kaisha, Toyota, Japan

[21] Appl. No.: 893,874

[22] Filed: Aug. 6, 1986

[30] Foreign Application Priority Data

Aug. 9, 1985 [JP] Japan ..... 60-175222

[51] Int. Cl.[4] ..... H01Q 1/32

[52] U.S. Cl. ..... 343/713; 343/712; 343/741; 343/744

[58] Field of Search ..... 343/711, 712, 713, 748, 343/866, 741, 744

[56] References Cited

U.S. PATENT DOCUMENTS

| | | | |
|---|---|---|---|
| 2,200,674 | 5/1940 | McDonald, Jr. | 343/702 |
| 2,212,253 | 8/1940 | Stief | 343/715 |
| 2,404,093 | 7/1946 | Roberts | 343/708 |
| 2,481,978 | 9/1949 | Clough | 343/712 |
| 2,520,986 | 9/1950 | Williams et al. | 343/712 |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 12/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/744 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/711 |
| 4,003,056 | 1/1977 | Davis | 343/713 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen Jr. | 343/712 |
| 4,339,827 | 7/1982 | Torres et al. | 343/748 |
| 4,342,999 | 8/1982 | Woodward et al. | 343/702 |
| 4,380,011 | 4/1983 | Torres et al. | 343/744 |
| 4,499,606 | 2/1985 | Rambo | 455/277 |
| 4,506,267 | 3/1985 | Harmuth | 343/744 |

FOREIGN PATENT DOCUMENTS

| | | |
|---|---|---|
| 0182497 | 11/1979 | European Pat. Off. . |
| 0183443 | 5/1986 | European Pat. Off. . |
| 0183520 | 5/1986 | European Pat. Off. . |
| 0181200 | 5/1986 | European Pat. Off. . |
| 0181120 | 5/1986 | European Pat. Off. . |
| 0181765 | 6/1986 | European Pat. Off. . |
| 0183523 | 6/1986 | European Pat. Off. . |
| 889618 | 9/1953 | Fed. Rep. of Germany . |
| 1131762 | 6/1962 | Fed. Rep. of Germany . |
| 7015306 | 9/1970 | Fed. Rep. of Germany . |
| 2425189 | 12/1974 | Fed. Rep. of Germany . |
| 2701921 | 7/1978 | Fed. Rep. of Germany . |
| 2745475 | 4/1979 | Fed. Rep. of Germany . |
| 2821202 | 11/1979 | Fed. Rep. of Germany . |
| 2733478 | 4/1980 | Fed. Rep. of Germany . |
| 1949828 | 6/1986 | Fed. Rep. of Germany . |
| 53-22418 | 8/1978 | Japan . |
| 0046617 | 4/1980 | Japan . |
| 59-44861 | 3/1984 | Japan . |
| 60-129464 | 8/1985 | Japan . |

OTHER PUBLICATIONS

Japanese Pat. Abstract, vol. 6, No. 37 E-97, Mar. 6, 1982, 56-156031.

Japanese Pat. Abstract, vol. 6, No. 55 E-101, 4/10/82, 56-168441.

Japanese Pat. Abstract, vol. 7, No. E-187, 7/15/83, 58-70640.

Japanese Pat. Abstract, vol. 7, No. 162 E-187, 7/15/83, 58-70642.

*Primary Examiner*—William L. Sikes
*Assistant Examiner*—Hoanganh Le
*Attorney, Agent, or Firm*—Cushman, Darby & Cushman

[57] ABSTRACT

The present invention provides a vehicle antenna system including a high frequency pickup with a loop antenna for detecting high frequency surface currents induced on the vehicle body by broadcast waves and concentratedly flowing on the marginal portions of the vehicle body, the loop antenna being longitudinally disposed in close proximity to a marginal portion of the vehicle body, the improvement including a switching diode on the loop antenna for changing the opening area thereof. Therefore, the loop antenna can stably receive waves through an increased range of bands independently of variations in power voltage.

5 Claims, 4 Drawing Sheets

VEHICLE ANTENNA SYSTEM

BACKGROUND OF THE INVENTION

1. Field of the Invention

The present invention relates to an improved vehicle antenna system which can efficiently detect broadcast waves received by the vehicle body and transmit them to various onboard receivers.

2. Description of the Prior Art

With modern automobiles, antenna systems are essential for positively receiving broadcast and/or communication waves at various onboard receivers such as radios, TV's, car-telephones and others. Antenna systems also have an important role in citizen band tranceivers as providing communication between an automobile and the other stationary or movable station. In the future, such a vehicle antenna system will increasingly be important for vehicles standardized with various receivers.

A pole type antenna is known as one of the conventional vehicle antenna systems. The pole antenna projects exteriorly from the vehicle body and exhibits a favorable performance of reception in its own way. However, the pole antenna was always an obstruction in the design of the vehicle body.

The pole antenna also is disadvantageous in that it may accidentally or intentionally be subjected to damage and in that the pole antenna may produce unpleasant noises while the vehicle runs at high speeds. Therefore, it was very desirable to eliminate the pole antenna from the vehicle body.

Recently, the number of frequency bands for broadcast or communication waves to be received on the automobiles are being increased. If a plurality of pole antennas are located on a vehicle body matching the increased number of frequency bands, they would degrade the aesthetic concept of the vehicle appearance. Furthermore, there would be created an electrical interference between the pole antennas to also remarkably degrade the reception performance Some attempts have been made to eliminate or conceal pole antennas. One such attempt involves applying an antenna wire to the rear window glass of the vehicle body.

Another attempt involves the use of a high frequency pickup which includes a loop antenna for detecting surface currents induced on the vehicle body by broadcast waves.

A conventional example of vehicle antenna systems utilizing such a loop antenna will now be described with reference to the drawings.

Referring to FIG. 6, there is shown an electromagnetic coupling type high frequency pickup 10 which includes a loop antenna 12 electrically connected with a variable capacity diode 14 and a pre-amplifier. FIG. 6 also shows a circuit including the variable capacity diode 14 and a receiver connected with the diode.

As can be seen from FIG. 6, the loop antenna 12 is connected in series with a capacitor $C_1$, the variable capacity diode 14 and a capacitor $C_2$. The total series capacity of these connected components determines a resonance frequency in the loop antenna 12. The output of the high frequency pickup 10 is taken out at one end of the capacitor $C_1$ and at the anode end of the variable capacity diode 14 and then subjected to desired impedance conversion and high frequency amplification by the aforementioned pre-amplifier which is located near the pickup 10. As shown, the pre-amplifier includes a band pass filter (BPF) for eliminating undesirable signals such as noise signals and others to select signals belonging to a desired frequency band. High frequency signals detected by the band amplification are then subjected to an impedance conversion in an impedance converting circuit which consists of resistors and capacitors and further to a high frequency amplification. Thereafter, the signals are supplied to the receiver through a coaxial cable 18. The pre-amplifier receives a power voltage used to control the circuit through a cable 20.

Signals detected by the pre-amplifier are maximum at the resonance frequency of the high frequency pickup 10. The capacity of the variable capacity diode 14 is varied to bring the resonance frequency in line with a desired reception frequency. This permits a miniaturized antenna to receive broadcast waves very sensitively. In the illustrated conventional example, the pre-amplifier further includes a neon tube NL for protecting the semiconductor elements from high voltages due to thunderbolt or static electricity.

In order to vary the capacity of the variable capacity diode 14, a predetermined control voltage is applied to the cathode side of the variable capacity diode 14. Such a control voltage is controlled in connection with a tuned frequency in the receiver.

FIG. 6 further shows a portion of the receiver 22 which comprises an antenna terminal 24 connected with the other end of the coaxial cable 18. The antenna terminal 24 also is connected with the next reception circuit through a tuning circuit 26 via a capacitor 28. The tuning circuit 26 is adapted to vary the inductance of a coil or the capacity of a capacitor to select a tuned frequency. The tuned frequency thus selected is controlled and selected by a tuned frequency control circuit 30 and at the same time digitally displayed on a display 32 in the interior of the vehicle body. On the other hand, a tuned frequency control voltage is supplied to the cathode of the variable capacity diode 14 from the tuned frequency control circuit 30 of the receiver 22 through a variable resistor 34 and a resistor 36. Thus, the variable capacity diode 14 will be supplied with a control voltage corresponding to the tuned frequency selected by the tuning circuit 26.

When a desired reception frequency is selected at the receiver 22, the high frequency pickup 10 will be controlled to bring its resonance frequency in line with said tuned frequency for receiving broadcast waves belonging to the desired frequency band.

As described hereinbefore, the resonance frequency in the loop antenna of the high frequency pickup depends on the inductance of the loop antenna and the total capacity of series-parallel capacitors. The inductance of the loop antenna depends on its own opening area. The prior art vehicle antenna system is thus adapted to use a variable capacity diode to vary the capacity of the capacitor means such that the reception can be carried out through an increased range of bands. Since the resonance frequency of the loop antenna may vary, for example, due to variation of the power voltage in the vehicle, the prior art vehicle antenna system requires another power supply for stabilizing the resonance frequency in the loop antenna. This increases the size of the vehicle antenna system.

SUMMARY OF THE INVENTION

It is therefore an object of the present invention to provide an improved vehicle antenna system including a loop antenna which can stably receive waves belonging to an increased range of bands without a stabilizing power supply even if there are more or less variations in power voltage.

To this end, the present invention provides a vehicle antenna system having a high frequency pickup with a loop antenna longitudinally disposed in close proximity to a marginal portion of the vehicle body so as to detect high frequency surface currents induced on the marginal vehicle portion by broadcast waves, the improvement comprising a switching diode on the loop antenna for changing the opening area thereof.

When the switching diode is turned on or off, the opening area of the loop antenna is steppingly varied to provide resonance frequencies of the loop antenna steppingly different from one another. Therefore, the loop antenna can stably receive waves through an increased range of bands independently of the power voltage variations.

DETAILED DESCRIPTION OF PREFERRED EMBODIMENT

Referring now to FIGS. 2 to 5, there is shown one embodiment of a vehicle antenna system according to the present invention which comprises a high frequency pickup having a loop antenna disposed in close proximity to the rearward margin of the roof panel on the vehicle body.

Figure 3:
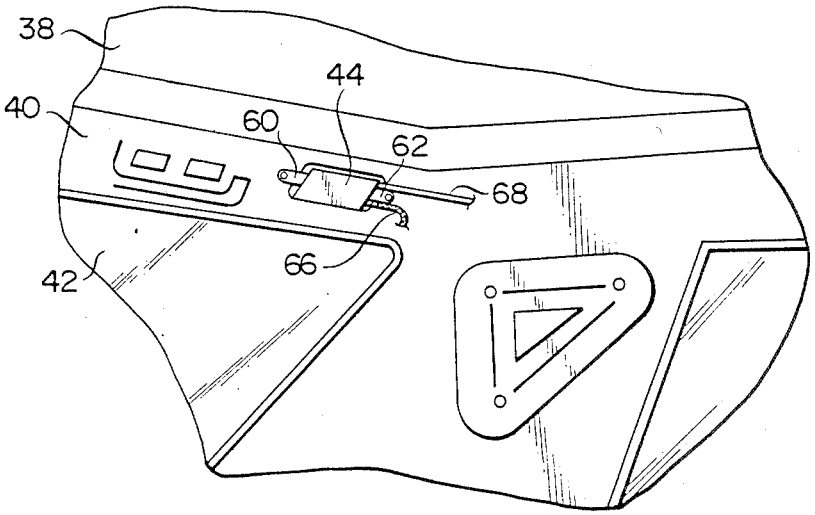

FIG. 3 shows a portion of the metallic roof panel 38 exposed to the interior of the passenger room. The metallic roof panel portion 38 includes a peripheral rear window frame 40 connected with a rear window glass 42. A high frequency pickup 44 is disposed spaced from the outer peripheral edge of the rear window frame 40 within a range (r) represented by:

$$r = 12 \times 10^{-3} \lambda (m)$$

where $\lambda$ is the wavelength of a broadcast wave measured in meters.

Figure 2:
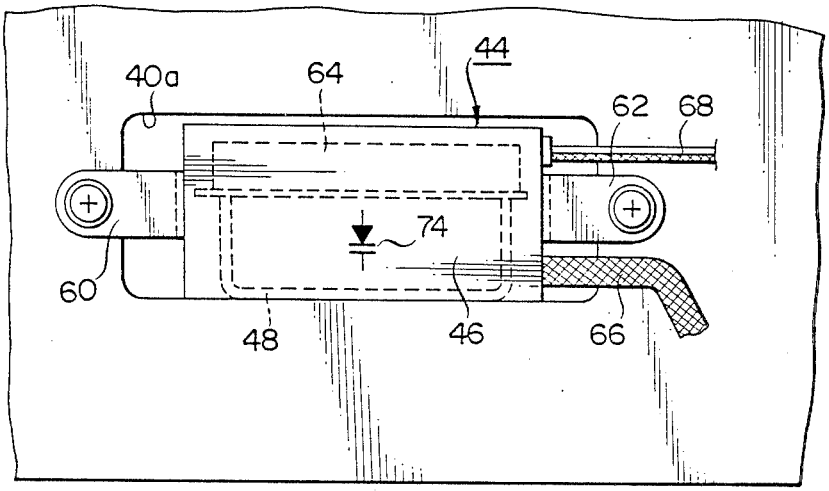
FIGS. 2 to 5 illustrate the mounting of the high frequency pickup shown in FIG. 1.

As can be seen from FIG. 2, the high frequency pickup 44 is in the form of an electromagnetic coupling type pickup which includes a metallic casing 46 for shielding external electromagnetic waves and a loop antenna 48 housed within the metallic casing 46.

Figure 4:
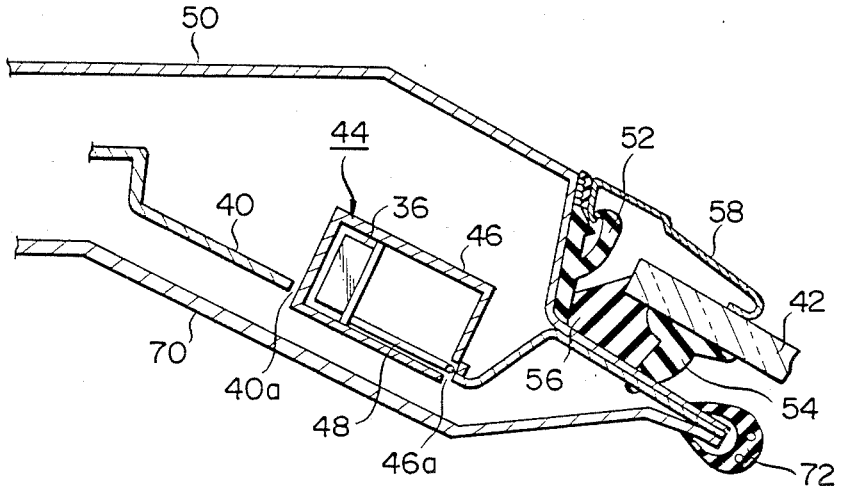

FIG. 4 shows the high frequency pickup 44 rigidly mounted on the roof panel 38 which includes a roof panel section 50. The aforementioned rear window frame 40 is rigidly connected with the roof panel section 50 at one edge. The roof panel section 50 also rigidly supports the rear window glass 42 through fastener means 52 and dam means 54. The fastener means 52 is sealingly attached to the dam means 54 through adhesive 56. A molding 58 is rigidly mounted between the roof panel section 50 and the rear window glass 42.

In the illustrated embodiment, the rear window frame 40 is provided with an opening **40*a* in which the high frequency pickup 44 is mounted. Thus, the loop antenna 48 within the high frequency pickup 44 is disposed in close proximity to the marginal portion of the rear window frame 40**.

As seen best from FIG. 4, the casing 46 is formed with an opening **46*a* through which the longitudinal side of the loop antenna 48 is externally exposed. The portion of the loop antenna 48 exposed through the opening of the metallic casing 46 will thus be located opposed and in close proximity to the edge of the opening in the rear window frame 40. In such a manner, a magnetic flux induced by high frequency surface currents flowing on the marginal portion of the rear window frame 40 can positively be detected by the loop antenna 48 within the casing 46. Furthermore, the metallic casing 46 can positively shield any external electromagnetic wave. Thus, the high frequency pickup 44** can sensitively detect currents induced on the vehicle body by broadcast waves.

Figure 5:
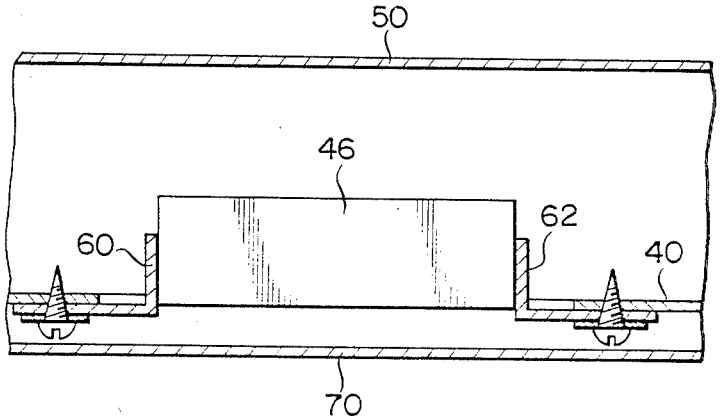
Figure 6:
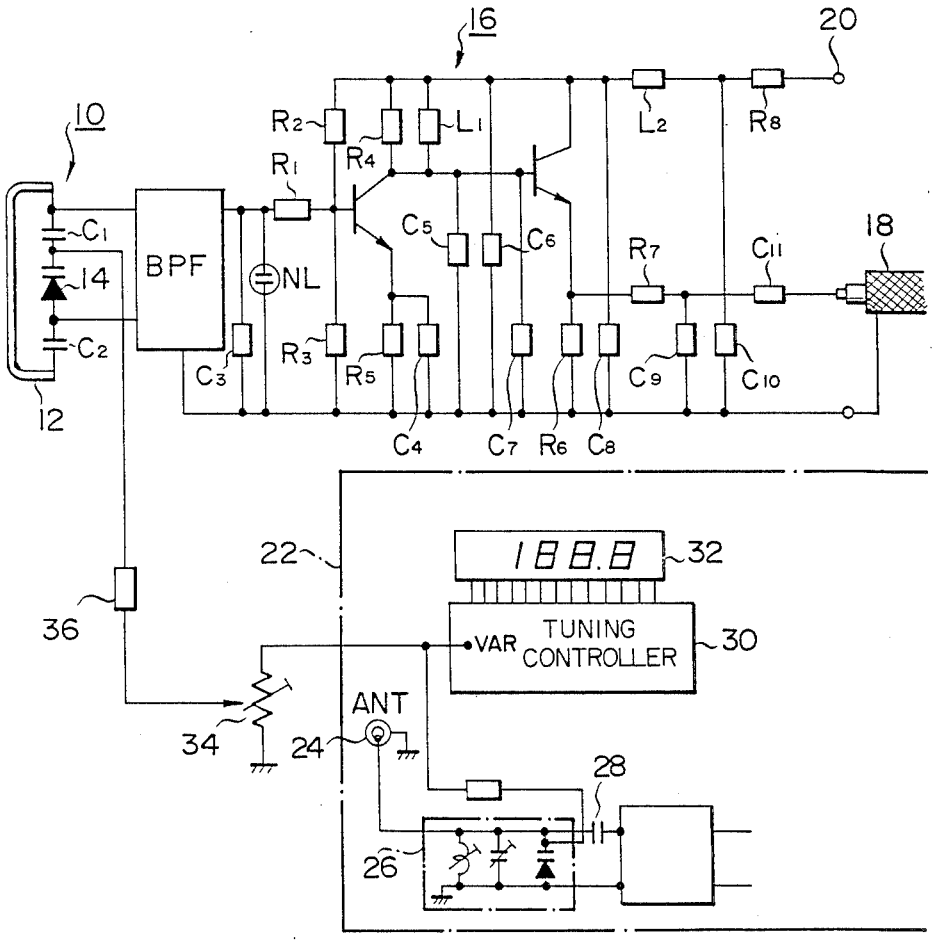
FIG. 6 PRIOR ART
FIG. 6 is a circuit diagram of a conventional vehicle antenna system with a portion of an onboard receiver in the vehicle body.

As seen from FIG. 5, the casing 46 of the high frequency pickup 44 can firmly be attached to the rear window frame 40 by the use of L-shaped brackets 60 and 62 which are rigidly mounted on the opposite ends of the casing 46 by bolts. These L-shaped brackets 60 and 62 also are rigidly connected with the rear window frame 40 by screws.

The casing 46 of the high frequency pickup 44 houses a circuit section 64 connected with the loop antenna 48. The circuit section 64 includes an impedance matching circuit and an amplifier circuit both of which are used to process detected signals. The processed high frequency signals are then taken out through a coaxial antenna cable 66 and transmitted to various onboard receivers such as radio, TV and others in the vehicle body. The circuit section 64 receives power and control signals through a cable 68.

The loop antenna 48 is in the form of a single insulated winding coil which is disposed in intimate contact with the rear window frame 40 under an electrically insulated state. Thus, the loop antenna 48 can more intensively intersect the magnetic flux created by the surface currents on the vehicle body.

After the high frequency pickup 40 has been mounted on the exposed roof panel 38 and particularly on the rear window frame 40, a roof garnish 70 is then attached to the roof panel. Furthermore, an edge molding 72 is rigidly mounted between the roof garnish 70 and the edge of the rear window frame 40.

The longitudinal side of the loop antenna 48 exposed through the opening of the casing 46 is preferably disposed spaced from the marginal portion of the rear window frame 40 within the aforementioned range (r) represented by:

$$r = 12 \times 10^{-3} \lambda.$$

Therefore, the loop antenna can positively detect surface currents induced on the vehicle body by broadcast waves belonging to an FM broadcast frequency equal to 80 MHz and flowing on the marginal portion of the rear window frame 40. Since the orientation of the surface currents flowing on the vehicle body is along the marginal portions thereof, the longitudinal side of the loop antenna 40 will be disposed parallel to the marginal edge of the rear window frame 40.

Thus, the vehicle antenna system described above is very advantageous in that its high frequency pickup can electromagnetically detect the surface currents flowing on the marginal portions of the vehicle body and particularly on the edge portion of the roof panel without any externally exposed antenna portion such that broadcast waves belonging to high frequency bands can positively be received by the high frequency pickup.

The present invention is characterized by a varicap diode 74 connected with the loop antenna 48 as a switching diode for changing the opening area of the loop antenna 48. The provision of such a varicap diode 74 permits a stable reception through an increased range of bands even if there are more or less variations in power voltage.

Figure 1:
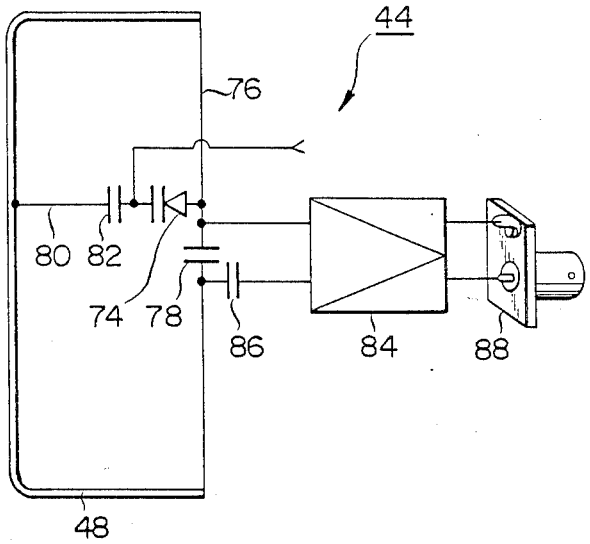
FIG. 1 is a schematic diagram of one embodiment of a vehicle antenna system constructed according to the present invention.

Referring now to FIG. 1, the loop antenna 48 has its opposite ends connected with each other by a leader line 76 through a capacitor 78. The loop antenna 48 also is connected substantially at its intermediate portion between the opposite ends with the leader line 76 by another leader line 80 through a DC cut capacitor 82 and the varicap diode or switching diode 74.

The opposite terminals of the capacitor 78 are connected, through two input lines, with a circuit section 84 which performs a impedance conversion and a high frequency amplification. A capacitor 86 is operatively located in one of the input lines. The circuit section 84 has its output line connected with a coaxial cable connector 88.

The cathode side of the varicap diode 74 is adapted to receive from a receiver (not shown) a DC control signal for changing the varicap diode 74 from the ON state to the OFF state or vice versa, depending on the desired band to be received, for example, FM band or TV band.

The DC control signal causes the varicap diode 74 to shift to its ON or OFF state such that the impedance thereof will be changed to be equal to zero or $\infty$. Thus, the opening area of the loop antenna will be changed at two steps. The loop antenna 48 can provide an opening area resonating with the FM or the TV band, that is, an inductance.

Since the varicap diode 74 is only actuated to be ON or OFF in the high frequency circuit, the loop antenna 48 will not be significantly influenced by variations of the power voltage applied to the varicap diode 74.

In accordance with the present invention, the capacitor 86 may be omitted. In such a case, the vehicle antenna system will have a series resonance type high frequency pickup in which the loop antenna thereof has a two-step changed opening area.

We claim:

1. A vehicle antenna system for detecting surface high frequency currents, induced by broadcast waves on a vehicle body and concentrated into marginal edges of the vehicle body, said antenna system comprising:

a case made of electrically conductive material and having an opening along one side thereof;

high frequency pickup means being disposed within said case and including a loop antenna having a length and a width, the length of said loop antenna being opposite the opening in said case, said high frequency pickup means further including a varicap diode connected to said loop antenna for changing the opening area of said loop antenna, said high frequency pickup means being provided for detecting the surface high frequency currents induced on a marginal edge portion of the vehicle body; and mounting means for mounting said case containing said high frequency pickup means with the opening of said case being arranged parallel and in close proximity to the marginal edge portion of the vehicle body.

2. A vehicle antenna system as defined in claim 1 the opening area of said loop antenna being changed in two steps when said varicap diode is turned on and off.

3. A vehicle antenna system as defined in claim 2 the opening area of said loop antenna being changed to resonate with an FM or TV frequency band.

4. A vehicle antenna system as defined in any one of claims 2, 3, and 1, said case containing said high frequency pickup means being disposed in close proximity to a rearward edge portion of a roof panel on the vehicle body.

5. A vehicle antenna system as defined in any one of the claims 2, 3, and 1, said case containing said high frequency pickup means being disposed spaced from the rearward edge portion of said roof panel within a range represented by:

$$12\times10^{-3}\lambda(\text{meters})$$

where $\lambda$ is the wavelength of a broadcast wave to be received.

* * * * *